US005951737A

United States Patent [19]

Lefebvre et al.

[11] Patent Number: 5,951,737

[45] Date of Patent: Sep. 14, 1999

[54] LUBRICATED ALUMINUM POWDER COMPOSITIONS

[75] Inventors: Louis-Philippe Lefebvre; Yannig Thomas, both of Montreal, Canada

[73] Assignee: National Research Council of Canada, Ottawa, Canada

[21] Appl. No.: 09/097,922

[22] Filed: Jun. 16, 1998

[51] Int. Cl.[6] ..... B22F 1/00

[52] U.S. Cl. ..... 75/252; 75/249; 75/231; 419/37; 419/57

[58] Field of Search ..... 75/249, 252, 231; 419/36, 37, 57

[56] References Cited

U.S. PATENT DOCUMENTS

| | | | |
|---|---|---|---|
| 3,791,800 | 2/1974 | McGee . | |
| 4,104,062 | 8/1978 | Weaver | 75/238 |
| 5,100,736 | 3/1992 | London et al. | 428/549 |
| 5,405,571 | 4/1995 | Truckner et al. | 419/8 |

OTHER PUBLICATIONS

H.C. Newbing and G. Jangg, "Sintering of Aluminum Parts: The State–of–the–Art", *Metal Powder Report*, May 1987, (42), 354–358.

J.N. Auburn and J.S. Choo, "Effect of Chemistry and Compact Density on the Decomposition of P/M Lubricants", *Advances in Powder Metallurgy and Particulate Materials*, 1994, (3), 103–116.

*Primary Examiner*—Ngoclan Mai

*Attorney, Agent, or Firm*—Juliusz Szereszewski

[57] ABSTRACT

Aluminum powder compositions intended for powder metallurgy applications are provided. The powder compositions contain aluminum and aluminum alloys or blends made from elemental powders, admixed with a polyethylene lubricant. The polyethylene admixture eases the compaction of powders and the ejection of parts. As compared to other conventional admixed lubricants used for Al powder metallurgy applications, polyethylene allows to obtain parts with higher green and sintered strengths. Proper delubrication prior to sintering is of importance.

10 Claims, 1 Drawing Sheet

LUBRICATED ALUMINUM POWDER COMPOSITIONS

FIELD OF THE INVENTION

The present invention relates to lubricated Al powder compositions for powder metallurgy (P/M) applications. The invention also relates to a method of fabricating compacts or components from such compositions.

BACKGROUND OF THE INVENTION

Powder metallurgy (P/M) is a well-established process for the fabrication of near net shape components. In press and sinter applications for example, the powder is compacted in a die to form a green compact. The compact is then ejected from the die and sintered to create metallurgical bonds between the particles. A lubricant is generally required to improve the compressibility of metal powders and also to reduce the powder/die wall friction in order to facilitate ejection and minimize die wear.

Die wall lubrication technology as disclosed in U.S. Pat. No. 3,871,877 to Storchheim allows the fabrication of compacts having high green strength and sintered properties. However, the use of die wall lubrication generally lowers the production rate and the technology is not always applicable for some part geometry (high die fill for example). Accordingly, for some applications, the use of admixed lubricants is the only alternative for the production of sound parts at low cost.

Lubricants are commonly admixed to metal powders for the compaction of powders by P/M techniques. However, known admixed lubricants have deleterious effects on some properties of the compacts. For example, admixed lubricants generally reduce interparticular cold welding and reduce the green strength of the compacts. This may be troublesome if the green strength is not sufficient to prevent delamination or crack formation during shaping or handling. This is particularly the case when spherical aluminum powders are used. In addition, admixed lubricant may negatively affect the sintered properties of the compacts. By reducing the interparticular friction, the lubricant may impede the formation of good metallurgical bonds between the particles during compaction and may thus affect the sintered properties of the parts. In addition, the reduction of the sintered properties may be important if the lubricant leaves residual products that impede the formation of metallurgical bonds during sintering. In fact, for aluminum P/M applications, the lubricant should burn out cleanly at a low temperature (generally not higher than 430° C.) to avoid the reaction of aluminum with the lubricant or residual products during sintering. Since aluminum sintering is sensible to the presence of oxygen, the lubricant should also be burned out in inert atmosphere.

Unlike for other metal powders, the only popular admixed lubricants for the fabrication of aluminum P/M components are synthetic amide waxes such as ethylene bisstearamide (EBS). EBS is a good lubricant that burns out cleanly at a low temperature. However, in comparison with parts fabricated with die wall lubrication, aluminum parts fabricated with admixed EBS have lower mechanical properties.

U.S. Pat. No 5,498,276 to Luk discloses powder compositions containing a poly(ethylene oxide) lubricant for the fabrication of compacts with improved green strength. However, this lubricant leaves carbon residues when heated in inert atmosphere at temperatures lower than 1000° C. For that reason, this lubricant should not be used for the fabrication of aluminum P/M components.

Polyethylene has been used as a lubricant for the fabrication of certain P/M components having improved green strength. It has also been used as a lubricant for the fabrication of iron components for press-and-sinter applications. However, decomposition of PE is reported to be complete at temperatures higher than 520° C. (J. N. Auborn and J. S. Choo, "Effect of Chemistry and Compact Density on the Decomposition of P/M Lubricants", *Advances in Powder Metallurgy and Particulate Materials,* 1994, (3), 103–116). Most ceramic and metal P/M components are sintered at temperatures much higher than the decomposition temperature of this lubricant. However, unlike for other metal or ceramic powders, this temperature limitation poses a problem for the fabrication of aluminum P/M components since Al parts must be free from lubricant residuals after a delubrication at a temperature lower than 430° C., according to H. C. Newbing and G. Jangg, "Sintering of Aluminum Parts: The State-of-the-Art", *Metal Powder Report*, May 1987, (42), 354–358.

SUMMARY OF THE INVENTION

It is an object of this invention to provide powder compositions for the fabrication of aluminum-based powder compacts having increased mechanical strengths.

According to one aspect of the invention, there is provided a metallurgical powder composition comprising an aluminum-based metallic powder and from about 0.1 to about 3 wt % solid polyethylene based on the total weight of the composition, preferably from about 0.2 wt. % to about 1.5 wt. %. The composition contains typically at least 50 wt % of the metallic powder. The metallic powder contains more than about 50 wt. % elemental aluminum.

The composition may further comprise standard (known) aluminum alloys and aluminum compatible alloying elements as well as binders, reinforcing components and solid lubricants for sliding applications.

According to another aspect of the invention, there is provided a process for producing an aluminum powder compact, the process comprising a) forming a composition containing predominantly an aluminum-based metallic powder and solid polyethylene in an amount from about 0.1 wt. % to about 3 wt. % of the composition distributed throughout said mixture, b) compacting said composition, c) heating said composition at a temperature not exceeding 450° C. in a non-oxidizing atmosphere for a time sufficient to substantially remove the polyethylene from said composition, and d) consolidating the composition of step c).

The term "consolidating" encompasses sintering, extrusion, rollng, forging, coining and other consolidation techniques known in powder metallurgy. Preferably, the temperature in step c) should not exceed about 430° C. The amount of the admixed polyethylene lubricant is preferably from about 0.2 wt. % to about 1.5 wt. % based on the weight of the composition.

BRIEF DESCRIPTION OF THE DRAWINGS

The invention will be explained in more detail by way of the following disclosure to be taken in conjunction with the drawing (FIG. 1) which illustrates the thermal treatment (delubrication and sintering) of exemplary aluminum powder mixes, or blends, lubricated with polyethylene.

DETAILED DESCRIPTION OF THE INVENTION

Figure 1:
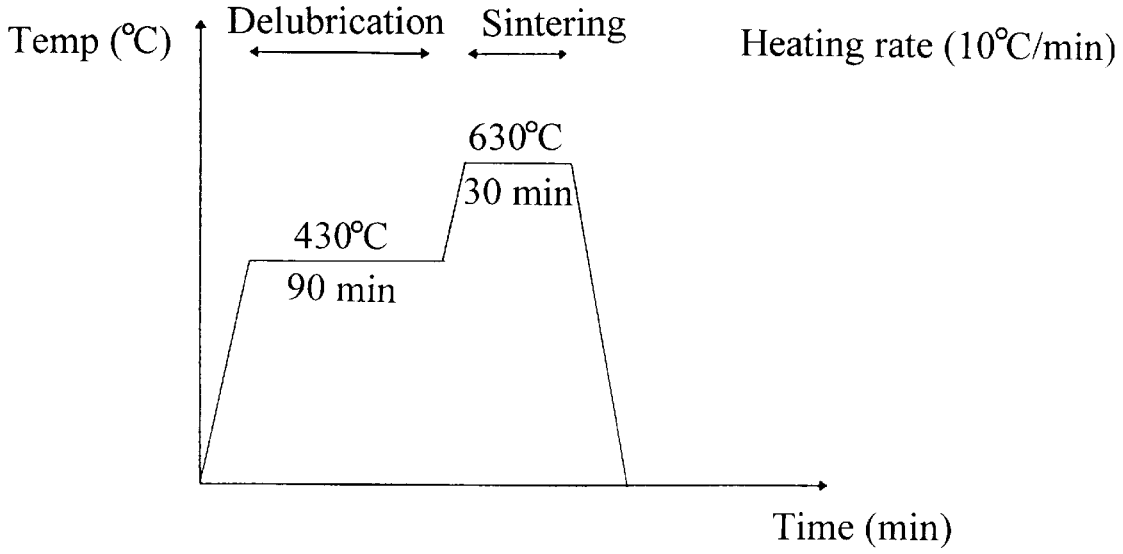

The present invention provides lubricated powder compositions for the fabrication of aluminum compacts for P/M applications. The metallic content of the composition is higher than 50 wt. % of the entire composition (before delubrication). The metallic content is composed of elemental aluminum powders, powdered aluminum alloys and alloying elements (compatible with aluminum), all commonly known in metallurgy. The final (after consolidation) bulk composition of the metallic phase contains typically more than 50 wt % Al, thus the elemental content of Al in the composition is at least 25 wt. % based on the weight of the composition. The particle size distribution of the metallic powders is nominally larger than 1 $\mu$m and less than 1000 $\mu$m, preferably between 10 $\mu$m and 250 $\mu$m. Additives such as standard reinforcements (SiC, $Al_2O_3$, fly ash etc.) and solid lubricants ($MoS_2$, BN etc.) for the fabrication of sliding parts may be admixed in the compositions.

The powder compositions contain a polyethylene lubricant, typically polyethylene wax, that is admixed to the powder or blends to provide lubrication during compaction and ejection. The lubricant is distributed uniformly throughout the composition in a manner well known in metallurgy. The admixed polyethylene may be the only lubricant or other lubricants may be present. Additional lubricants (admixed or sprayed into die cavities or punches) and binders may be used to improve lubrication. Additionally, binders may be used to improve the flowability and/or to reduce segregation and dusting.

Polyethylene may be admixed to the metallic powders in the solid state, in solution, emulsion or in melted state. The polyethylene content is typically between about 0.1 wt % and about 3 wt. % but preferably between 0.2 and 1.5 wt % based on the total weight of the composition.

The powder compositions of the invention can be compacted using conventional powder metallurgy conditions. The compacting pressures are typically lower than 800 MPa and more specifically between 100 and 700 MPa. The powder compositions may be compacted using die wall lubrication.

It is believed that polyethylene does not dramatically reduce the interparticle cold welding (also named interparticle or intermetallic bonds or contacts) during compaction as it is the case when synthetic amide waxes, e.g. EBS are admixed with the aluminum powders.

Formation of intermetallic contacts is believed necessary to provide components having high mechanical strength. These metallic contacts are believed to be required to allow diffusion paths and create good metallurgical bonds between the particles during sintering.

Our tests have proven that complete delubrication of an aluminum powder compact can be achieved in an inert atmosphere at a temperature lower than 450° C. without leaving a residue. The delubrication is achieved in an inert atmosphere at a temperature from 400° C. up to 450° C. depending on the delubrication atmosphere, material, part size and geometry. In a specific example, delubrication was carried out at 430° C. The delubrication duration may vary from 10 minutes to 2 hours and longer, and more specifically between 20 minutes and 90 minutes. After delubrication, the samples are subjected to a consolidation step which may be sintering, extrusion, rolling, forging, coining or other techniques known in metallurgy. The consolidation is carried out according to the specification of the material. For press-and-sinter applications, for instance, the compacts may be sintered at a temperature ranging from 550 up to 640° C. in an inert atmosphere or vacuum. The components may be subjected to post-consolidation treatments like machining, heat treating and coating.

EXAMPLES

The following examples present the advantages of the powder compositions of the invention. Properties of Al powder compacts fabricated with admixed polyethylene (PE: Acumist B-12, Allied Signal Inc.) were compared to properties of compacts fabricated with a traditional EBS lubricant (EBS: Acrawax C, Lonza Inc.). The aluminum based powders were dry mixed in a "V" type mixer for 30 min (26 rpm) with 1.2 wt % lubricant. The samples were fabricated with pre-alloyed and elemental mixed Al-6061. The aluminum powders were provided by Valimet Inc. The composition of the pre-alloyed Al-6061 powder used was 0.25% Cu, 0.9% Mg, 0.6% Si, 0.07% Cr, 0.24% Fe, 0.04% Mn, 0.02% Ti, 0.01% Zn and its particle size distribution was lower than 170 mesh US. The aluminum powder used for the elemental blends was a pure aluminum provided by Valimet Inc. (Al-H-50, −100 mesh US). Both aluminum powders were atomized with inert gas and were spherical. The additives, Mg, Cu and Si (−325 mesh US) for the elemental mixes were provided by Alfa, Cerca and Consolidated Aeronautics respectively. The additives were all pure metals. The powder mixes were compacted at 65° C/25 tsi in a floating die (tool steel). All the samples were compacted using a hydraulic press. No die wall lubrication was used in the experiments. All the samples were easily ejected from the die.

The samples were delubricated in nitrogen at 430° C. for 1 h30 min before sintering. Sintering was done in the same heating cycle in nitrogen at 630° C. for 30 min. The heating rate was 10° C./min both for delubrication and for the sintering stage. FIG. 1 shows the sintering procedure used in the experiments. The sintering was done in a tube furnace. The heating cycles were started after the atmosphere in the furnace reached a dew point lower than 40° C. The sintered samples were all solution treated (TO) before the mechanical tests. The solution treatment includes a heat treatment at 520° C. for 30 min in $N_2$ and a quenching in water.

Density was evaluated using the physical dimensions of the compacts. Transverse rupture strength (TRS) tests were done conformed to MPIF standard no 15. The results presented are the average of measurements done on five samples.

Example 1

Table 1 presents the green properties of compacts fabricated with elemental blends Al-6061 containing 1.2 wt % lubricant (polyethylene or EBS) compacted at 65° C./25 tsi. The results indicate that the density of the samples fabricated with the two types of lubricant is similar. On the other hand, the green strength of the samples fabricated with PE is significantly higher than the green strength of the samples fabricated with EBS (more than 2.5 times higher). It indicates that the nature of the lubricant significantly affects the green strength of the compact and the use of polyethylene allows to obtain parts with improved green strength This effect is believed to be due to the formation of good interparticle bonds during compaction when polyethylene is used.

TABLE 1

Green properties of compacts fabricated with elemental mixes (blends) A1-6061 admixed with 1.2 wt % lubricant (compaction 65° C./345 MPa).

| Lubricant | Density ($g/cm^3$) | TRS ($MPa$) |
|---|---|---|
| PE | 2.59 | 26.6 |
| EBS | 2.57 | 9.5 |

Similar experiments were conducted using pre-alloyed Al-6061 powders admixed with the same two lubricants (polyethylene or EBS). The results obtained (Table 2) with the pre-alloyed powder follow the same trend observed with the elemental mixes. The density is little affected by the type of lubricant used and the green strength is significantly improved when polyethylene is used.

TABLE 2

Green properties of compacts fabricated with pre-alloyed A1-6061 admixed with 1.2 wt % lubricant (compaction 65° C./345 MPa).

| Lubricant | Density ($g/cm^3$) | TRS ($MPa$) |
|---|---|---|
| PE | 2.49 | 16.2 |
| EBS | 2.49 | 9.4 |

Example 2

Table 3 presents the sintered properties of compacts fabricated with elemental mixes Al-6061 containing 1.2 wt % lubricant (polyethylene or EBS) compacted at 65° C./345 MPa. The results indicate that the sintered density of the samples fabricated with the two types of lubricant is similar. On the other hand, the sintered strength of the samples fabricated with PE is significantly higher than the sintered strength of the samples fabricated with EBS. In addition, the energy absorbed during the transverse rupture test (area under the TRS curve) is also significantly improved when polyethylene is used instead of EBS. This indicates that the sintered samples fabricated with the powder lubricated with PE are stronger and tougher than the samples fabricated with EBS. It indicates that the nature of the lubricant significantly affects the sintered strength of the compact and the use of polyethylene allows to obtain parts with improved sintered properties. This effect is believed to be due to the formation of good interparticle bonds during compaction when PE is used.

TABLE 3

Sintered properties of compacts fabricated with elemental mixes A1-6061 admixed with 1.2 wt % lubricant (compaction 65° C./345 MPa).

| Lubricant | Density ($g/cm^3$) | TRS ($MPa$) | Rupt. Energy ($J$) |
|---|---|---|---|
| PE | 2.58 | 261 | 5.3 |
| EBS | 2.56 | 190 | 2.8 |

Similar experiments were conducted using pre-alloyed Al-6061 powders admixed with the same two lubricants (PE or EBS). The results obtained (Table 4) with the pre-alloyed powder follow the same trend observed with elemental mixes. For the processing conditions and powder used, the density is little affected by the type of lubricant (PE or EBS). On the other hand, the sintered strength and the energy absorbed during the transverse rupture test is significantly improved when PE is used instead of EBS.

TABLE 4

Sintered properties of compacts fabricated with pre-alloyed A1-6061 admixed with 1.2 wt % lubricant (compaction 65° C./345 MPa).

| Lubricant | Density ($g/cm^3$) | TRS ($MPa$) | Rupt. Energy ($J$) |
|---|---|---|---|
| PE | 2.53 | 409 | 9.4 |
| EBS | 2.51 | 350 | 5.1 |

To summarize, the powder compositions of the invention contain aluminum, aluminum alloys or blends and a polyethylene lubricant. Aluminum is the major or predominant component of the composition. The amount of elemental aluminum is at least 25 wt. % of the composition. Parts fabricated using the powder compositions of the invention have higher green and sintered strengths as compared to components fabricated using a conventional lubricant. It is believed that unlike other lubricants, polyethylene does not overly reduce the formation of interparticle contacts (cold welds, bonds) during compaction. These metallic bonds give rise to parts with high green and sintered strength. In addition, unlike most lubricants, polyethylene burns out cleanly at temperatures below those at which the fabrication of aluminum P/M components can be impaired.

We claim:

1. A metallurgical powder composition comprising aluminum powder and from about 0. to about 3 wt % polyethylene lubricant based on the total weight of said composition.

2. The composition according to claim 1 wherein the content of polyethylene is from about 0.2 wt. % to about 1.5 wt. % based on the total weight of the composition.

3. The composition of claim 1 comprising at least 50 wt % of a metallic powder.

4. The composition of claim 3 wherein at least 50 wt. % of said metallic powder is aluminum.

5. The composition of claim 1 further comprising aluminum alloys and aluminum compatible alloying elements.

6. The composition according to claim 1 further comprising reinforcing components.

7. A process for producing an aluminum powder compact, the process comprising a) forming a composition comprising an aluminum-based metallic powder and solid polyethylene in an amount from about 0.1 wt. % to about 3 wt. % of the composition, said polyethylene being distributed throughout said composition, b) compacting said composition to form a compact, c) heating said compact at a temperature not exceeding 450° C. in a non-oxidizing atmosphere for a time sufficient to substantially remove the polyethylene from said compact, and d) consolidating the compact of step c).

8. The process according to claim 7 wherein the temperature in step c) does not exceed about 430° C.

9. The process according to claim 8 wherein the amount of said polyethylene is from about 0.2 wt. % to about 1.5 wt. % based on the weight of said composition.

10. The process according to claim 7 wherein said aluminum-based powder comprises at least about 25 wt. % elemental aluminum.

* * * * *